US007628869B2

(12) United States Patent
Martin et al.

(10) Patent No.: US 7,628,869 B2
(45) Date of Patent: Dec. 8, 2009

(54) STEEL COMPOSITION, ARTICLES PREPARED THERE FROM, AND USES THEREOF

(75) Inventors: Gary S. Martin, Greenville, SC (US); Sujith Sathian, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 587 days.

(21) Appl. No.: 11/289,241

(22) Filed: Nov. 28, 2005

(65) Prior Publication Data

US 2007/0122601 A1 May 31, 2007

(51) Int. Cl.
*C22C 38/00* (2006.01)

(52) U.S. Cl. ..... 148/320; 52/848

(58) Field of Classification Search ..... 148/320; 52/726.3, 726.1, 726.4, 720.1
See application file for complete search history.

(56) References Cited

U.S. PATENT DOCUMENTS 3,914,135 A * 10/1975 Kozasu et al. ..... 148/660
4,008,103 A * 2/1977 Miyoshi et al. ..... 148/653
4,025,368 A * 5/1977 Sanbongi et al. ..... 420/83
4,397,698 A 8/1983 Davenport et al.
5,080,727 A 1/1992 Aihara et al.
5,146,096 A 9/1992 McConachy
5,182,458 A 1/1993 McConachy
5,545,270 A * 8/1996 Koo et al. ..... 148/654
5,687,537 A * 11/1997 Noble ..... 52/849
6,467,233 B1 10/2002 Maliszewski et al.
6,470,645 B1 10/2002 Maliszewski et al.
6,532,700 B1 3/2003 Maliszewski et al.
7,294,412 B2 * 11/2007 Takada et al. ..... 428/659

OTHER PUBLICATIONS

ASTME23-01. "Standard Test Methods for Notched Bar Impact Testing of Metallic Materials" pp. 1-26.
BS EN 10113-2:1993. "Hot-rolled products in weldable fine grain structural steels, Part 2. Delivery conditions for normalized/normalized rolled steels". 13 pages.

* cited by examiner

*Primary Examiner*—Brian E Glessner
*Assistant Examiner*—Adriana Figueroa
(74) *Attorney, Agent, or Firm*—Cantor Colburn LLP

(57) ABSTRACT

An article as disclosed herein comprises a steel comprising carbon in an amount greater than 0.18 weight percent and less than or equal to 0.23 weight percent by ladle analysis, wherein a test article consisting of the steel has a low temperature Charpy V-notch toughness of greater than or equal to 54 Joules when measured at −40° C. according to ASTM E23-01, and wherein a test article consisting of the steel further meets the other test requirements for S355NL steel according to European Norm EN 10 113-2:1993. In an embodiment, the article is a flange for a wind tower, and is suitable for use under extremely cold operating conditions (to −30° C.). A method for forming the flange is also disclosed.

20 Claims, 4 Drawing Sheets

STEEL COMPOSITION, ARTICLES PREPARED THERE FROM, AND USES THEREOF

BACKGROUND OF THE INVENTION

This disclosure relates to a steel composition and an article prepared there from, and uses of the article prepared from the steel composition.

With the present emphasis on alternative power sources, use of wind power for generating electricity is spreading to far flung areas of the globe. Towers for electricity-generating windmills, also referred to as wind towers, are being erected in geographical areas having varied climate conditions, and as such may be subject to mechanical stresses that can arise depending upon these conditions. Operating conditions of greatest concern for wind towers include extreme wind conditions, and extremely cold temperatures.

A wind tower is typically constructed of a generating unit having a wind driven turbine connected to a generator housed in a nacelle, and a tower of an appropriate height and anchored to a base, to support the nacelle. The tower is typically hollow to allow access to the nacelle by a ladder. The height of the tower may be determined according various considerations such as the terrain; the size of the turbine and generating unit; and other conditions such as the average wind speed. The towers are fabricated using materials of construction selected according to the operating conditions for the tower in its site. The tower itself is constructed in several sections joined together by a combination of welding and bolting. Wind towers typically have an expected operating lifetime of about 20 years.

Steel components used in the construction of the primary stress points must withstand the applied stresses under the operating conditions of the wind tower in the environment in which it is situated, for the lifetime of the tower. Wind towers situated at higher latitudes (greater than about 40 degrees north latitude and/or at higher elevations of greater than about 500 meters above sea level) may be subject to a combination of greater extremes of temperature and wind forces than typically encountered at latitudes below these. A combination of conditions which includes low temperatures (as low as −30° C.) and wind speed as high as about 100 miles per hour (mph; about 167 kilometers per hour (kph), sometimes referred as "cold weather extreme" (CWE) conditions, can place significant stress upon mechanical joints of a wind tower. In particular, where a wind tower is constructed of several sections bolted together, a great deal of mechanical stress is carried by the flanges welded to the ends of the section, that provide surfaces for bolting the sections together. A flange that is designed to operate under less rigorous extremes of conditions (e.g., higher minimum temperatures and/or lower maximum wind speeds) may prematurely develop stress related defects in the joints and may have a higher likelihood of failure. The material of construction of the flange (i.e., the steel used) desirably exceeds mechanical requirements appropriate for CWE conditions. Current materials of construction may not consistently provide the desired mechanical performance.

What is needed therefore, is a flange comprising a steel composition that can consistently meet or exceed the mechanical requirements for steels having the properties disclosed in European Norm (EN) 10 113-2:1993. A flange will desirably have low temperature performance suitable to provide defect-free operation over the lifetime of the wind tower.

SUMMARY OF THE INVENTION

The above described deficiencies are overcome by, in an embodiment, an article comprises a steel comprising carbon in an amount greater than 0.18 weight percent and less than or equal to 0.23 weight percent by ladle analysis, wherein a test article consisting of the steel has a low temperature Charpy V-notch toughness of greater than or equal to 54 Joules when measured at −40° C. according to ASTM E23-01, and wherein a test article consisting of the steel further meets the other test requirements for S355NL steel according to European Norm EN 10 113-2:1993.

In another embodiment, a flange comprises a steel, wherein the steel comprises greater than 0.18 weight percent and less than or equal to 0.23 weight percent by ladle analysis, and greater than 0.20 weight percent to less than or equal to 0.25 weight percent carbon by product analysis; wherein the steel meets compositional requirements for S355NL steel for elements other than carbon, according to European Norm EN 10 113-2:1993, wherein the steel is weldable, wherein a test article consisting of the steel has a low temperature Charpy V-notch toughness of greater than or equal to 54 Joules when measured at −40° C. according to ASTM E23-01, and wherein a test article consisting of the steel further meets the other test requirements for S355NL steel according to European Norm EN 10 113-2:1993.

In another embodiment, a method of making a flange for use in a wind tower comprises shaping a section of steel comprising: a steel composition comprising iron, greater than 0.18 weight percent to less than or equal to 0.23 weight percent carbon by ladle analysis, and additional elements, wherein the steel composition meets compositional requirements for S355NL steel for the additional elements according to European Norm EN 10 113-2:1993; wherein a test article consisting of the steel has a low temperature Charpy V-notch toughness of greater than or equal to 54 Joules when measured at −40° C. according to ASTM E23-01, and wherein a test article consisting of the steel further meets the other test requirements for S355NL steel according to European Norm EN 10 113-2:1993.

We turn now to the figures, which are meant to be exemplary of the embodiments and not limited thereto.

DESCRIPTION OF THE INVENTION

Figure 1:
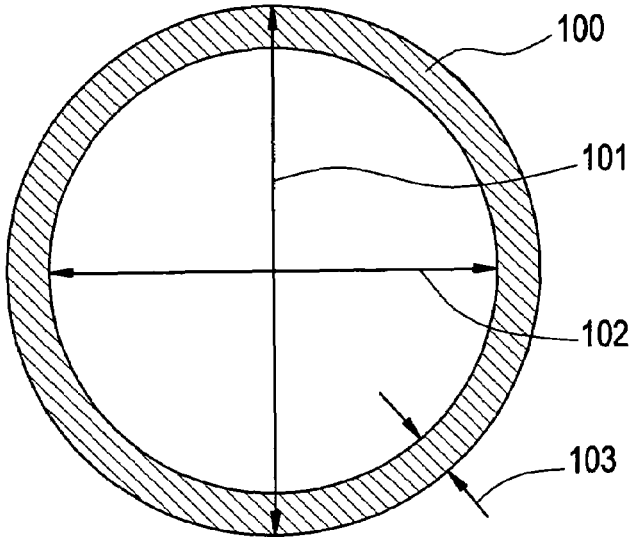
FIG. 1 shows a top view of a flange.

Surprisingly, it has been found that an article comprising a steel composition having a carbon content by ladle analysis of greater than 0.18 weight percent (wt %) to less than or equal to 0.23 wt % provides a yield strength in accordance with the requirements for S355NL steel according to European Norm 10 113-2:1993. In addition, both a Charpy V-Notch (low temperature) toughness of 54 Joules (J) as measured at −40° C. according to ASTM E23-01, and weldability are maintained. In an embodiment, the article is a flange for use in a wind tower operating at low temperatures as low as −30° C. The steel composition meets the compositional specifications set out in European Norm (EN) 10 113-2:1993 for S355NL steel. Other desirable mechanical properties for steel prepared with the composition can also include, for example, tensile strength.

Articles disclosed herein, specifically flanges for joining tower sections to construct a wind tower, are fabricated from forged steel or welded plates. Steel, according to European standard EN 10 020, is a material which contains more iron by weight than any other single element, has a carbon content generally less than 2 percent by weight, and which may contain other alloying elements. A steel, specifically a carbon steel is basically a refined pig iron, which is typically prepared by combining iron ore, coke, limestone, and oxygen, and superheating the mixture to 1,600° C. or higher in a blast furnace. The ensuing hot liquefied pig iron is combined with other additives such as alloying elements and additional oxygen in a basic oxygen furnace, generally using a process developed by a particular manufacturer. Generally in such processes, high purity oxygen is blown through the molten metal bath to lower the carbon, silicon, manganese, and phosphorous content of the iron, while various fluxes are used to reduce the sulfur and phosphorous levels. The carbon content of the steel can be controlled by the amount of oxygen used, wherein the process of reduction of the carbon content of the steel is sometimes referred to as "decarburizing". The carbon content of the steel may thus be reduced to the desired level. Alloying metals, and up to about 30% scrap metal, may be added as well to provide a desired overall composition, also referred to as the "ladle composition". Mills which produce smaller volumes of molten carbon steel in electric arc furnaces, referred to as "mini-mills", almost exclusively use scrap metal rather than iron ore and may frequently therefore produce steel with a less well controlled composition.

The molten carbon steel is transferred from the furnace to a preheated ladle, and is poured from the ladle into the tundish of a continuous strand caster. From the tundish, it flows into the caster's molds to cool and form a shape such as a slab, bloom, or billet. The shaped form of the steel moves through the caster, cooling as it progresses, until it exits the caster, where it is cut to length, typically using a torch. The slab, bloom, or billet may then either be placed in inventory or transferred to a reheat furnace where it is heated to a uniform rolling temperature for secondary finishing. Secondary finishing may include reheating, surface conditioning, hot rolling, cold rolling, heat-treating, surface coating, cooling, cutting, coiling, and sizing. Heat-treating the steel is done to affect the size and alignment of the crystalline structure of the metal, the carbon, and other elements in the steel, and generally involves heating the steel with specific temperature control, atmosphere control, and controlled cooling processes. Heat treating processes include annealing, normalizing, accelerated cooling, quenching, and tempering. In structural mills, the steel blooms or billets are brought to uniform temperature in continuous reheat furnaces and then passed through roughing, intermediate, and finishing mills to produce the desired shapes.

The steel may be assessed according to its composition, and according to related mechanical properties including: strength (also referred to herein as "yield strength"), defined as the ability to withstand mechanical stress; toughness, which is the ability of the steel to absorb shock without breaking; ductility, which is the ability of the steel to be formed without fracturing; hardness, which is the steel's ability to resist deformation, abrasion, cutting, crushing, and the like; and fatigue resistance, which is the ability of the steel to undergo cyclic forces without failure (i.e., breaking). Weldability is also a useful measure of the steel, which is defined as the ability of the steel to form a structurally sound weld with a welding composition. Weldability is governed by the miscibility of the welding material and the steel, and is typically governed by the steel composition. Herein, specific useful properties for the steel as used for low temperature structural applications include yield strength, toughness as measured at low temperatures (−20 deg C. or less) by the Charpy V-notch toughness test, and weldability.

Normalized steel is a steel that has been heated to a temperature above its transition point and cooled in air, to reduce the grain size of the steel, and so that the grains are uniformly distributed and aligned throughout the steel. Normalized steel is characterized by better low temperature toughness and homogeneity in quality than other structural steel such as rolled steel. Steel suitable for use herein may be obtained from a manufacturer as normalized steel, which is suitable for use in low temperature applications. Normalized steel may have a lower mechanical strength than rolled steel, but can be alloyed with other elements to improve its mechanical properties.

Nomenclature of standard steels according to European Norm EN 10 027-1 is broken down in the following manner. A steel is designated by: the symbol S; an indication of the minimum specified yield strength as expressed in Mega-Pascals (MPa; also defined as Newtons per square millimeter or $N/mm^2$) for a steel having a thickness of 16 millimeters, wherein the minimum yield strength of these steel grades is from 275 to 460 MPa; the delivery condition used, i.e., N (Normalized) or M (Thermomechanically formed); and how the impact testing of the sample was determined to provide the specified minimum value, i.e., measured using longitudinal test pieces tested at either −20° C. (with no letter suffix) or −50° C. (with an "L" suffix). An example of a normalized steel with a high strength at low temperature is S355NL, wherein the yield strength at less than or equal to 16 mm thickness is 355 MPa and which meets the impact testing specification value (herein, greater than or equal to 31 Joules) when tested using a sample at a temperature of −40° C. Steel conforming to these criteria may be used in applications requiring the steel to support heavily loaded parts of welded structures such as wind towers, but also including bridges, storage tanks, and the like.

Suitable carbon steel have a manganese content that does not exceed 1.65 wt % by weight. Manganese may thus be present in amounts of 1.0 to 1.65 wt % with a useful upper limit being about 1.5 wt %. It has been observed in the art that manganese in excess of 1.5 wt % may cause a deterioration of yield strength and impact properties as a result of the formation of undesired crystalline substructures which weaken the structure of the steel. In addition, the silicon and copper contents of carbon steel are less than 0.60 wt %, whereas no minimum content is specified for alloying elements such as aluminum, chromium, molybdenum, nickel and vanadium. A steel may further contain an element suitable for binding available nitrogen, such as for example aluminum (Al) in an amount of greater than or equal to 0.02 wt %. Steels containing a nitrogen binder are referred to in the art as "killed" steels.

According to EN 10 113-2:1993 specifications by ladle analysis, S355NL steel further comprises manganese at 0.9 to 1.65 wt %; silicon at less than or equal to 0.5 wt %; phosphorous at less than or equal to 0.03 wt %; sulfur at less than or equal to 0.025 wt %; niobium at less than or equal to 0.05 wt %; vanadium at less than or equal to 0.12 wt %; titanium at less than or equal to 0.03 wt %; aluminum at greater than or equal to 0.02 wt %; chromium at less than or equal to 0.30 wt %; nickel at less than or equal to 0.5 wt %; molybdenum at less than or equal to 0.1 wt %; copper at less than or equal to 0.35 wt %; and nitrogen at less than or equal to 0.015 wt %.

Optimum welding performance, referred to herein as the weldability of a steel composition, can be affected by both the steel composition and by metallographic structure (i.e., grain structure) of the steel. A higher relative content of alloying elements in the steel composition, where the presence of one or more of the additional elements and/or carbon approaches its compositional limit, can increase the tensile strength of a steel prepared from the composition. However, increased content of alloying elements in the steel composition can also degrade the weldability of the steel.

Weldability is generally obtained by minimizing the carbon equivalence, which is a relative factor calculated using a formula weighted to provide a net assessment of carbon and similarly acting elements to gauge the welding performance of a steel composition. For steel compositions, the following formula for determining carbon equivalence of a steel composition by ladle analysis is used according to EN 10 113 (Note: for the purpose of the calculation, all values of the elements shown are used in weight percent (wt %)):

$$\text{Carbon Equivalence in wt \% } C(C_{eq}) = C + \frac{(Mn)}{6} + \frac{(Ni + Cu)}{15} + \frac{(Cr + Mo + V)}{5}.$$

Specifically, reducing the carbon content of a steel can improve its weldability and other mechanical properties. Weldability is further affected by the rate of cooling of a steel composition. Rapid cooling increases susceptibility to cold cracking and is controlled by the combined thickness of the heat paths away from the weld, and thus the overall thickness of the steel is a consideration. Reducing the carbon equivalent at a specified thickness can thus increase the range of conditions under which the steel can be welded. For acceptable weldability for steel having a thickness of greater than 63 millimeters, the carbon equivalence of a steel composition as calculated using the above equation should be maintained at a value of less than or equal to 0.45. For steel having a thickness of less than or equal to 63 millimeters, the carbon equivalence should be maintained at less than or equal to 0.43.

It has been observed that a high percentage of the flanges, made using either forged steel or welded plates, and using steel prepared according to the composition of S355NL, nonetheless fail to meet the minimum yield strength required by EN 10113-2:1993. For example, a flange having a thickness of 100 to 150 mm requires a minimum yield strength of 295 MPa according to EN 10 113-2:1993. However, after final heat-treatment and upon testing, approximately 20% of the total number of flanges prepared using S355NL steel fall short of the desired yield strength value by as much as about 20 to about 30 MPa. In addition, S355NL steel, according to EN 10 113-2:1993, specifies a minimum low temperature toughness (Charpy V-notch) of 31 Joules when measured at −40° C. which can be insufficient for low temperature performance of Cold Weather Extreme (CWE) steel flanges. Operation of wind tower turbines is typically continued down to temperatures as low as −30° C., and is discontinued below this temperature. Lower yield strength and insufficient low temperature toughness of the steel composition in the flange can lead to undesirable performance of the stress-bearing components of a wind tower under such low temperature operating conditions, including premature aging defects of the flange from developing stress cracks and related defects. The normal life span of a wind tower is 20 years; thus, premature formation of such defects in a span of less than 20 years can pose a safety risk which can lead to a shortened life span for the tower, and which poses an adverse economic risk. The lowered flange yield is thus also undesirable from a process efficiency standpoint, leading to a higher first-pass yield failure rate for the flanges, which can lead to increased costs associated with shipping of the billets and finished flanges, manufacture of the flanges, and testing.

Surprisingly, it has been found that modification of the steel composition of S355NL by increasing the carbon content to an amount greater than 0.18 wt % and less than or equal to 0.23 wt % (where the carbon content of S355NL steel, according to EN 10 113-2:1993, is less than or equal to 0.18 wt %), improves the yield strength and low temperature toughness of the steel composition without compromising the weldability. The steel so modified has improved low temperature (Charpy V-notch) toughness of greater than or equal to 54 Joules when measured at −40° C. according to ASTM E23-01, and further meets the other test requirements for S355NL steel according to European Norm EN 10 113-2:1993. The steel has good weldability in addition to improved low temperature mechanical properties. The weldability, as determined using the carbon equivalence of the steel, may be maintained to the requirements of EN 10 113-2:1993 by effecting a commensurate reduction in the level of at least one of the other metals affecting the carbon equivalence, including Mn, Ni, Cu, Cr, Mo, V, or a combination of two or more of these. In a specific embodiment, the Mn content may be reduced by an amount sufficient to compensate for the increased carbon content. For example, according to the equation above for calculating $C_{eq}$ values, to maintain a $C_{eq}$ value of 0.45 when the carbon content is increased by 0.02 wt %, the Mn content can be reduced by 0.12 wt %. Thus, in an embodiment, with the increased carbon content included, the steel described herein has a carbon equivalence suitable to maintain adequate weldability. A flange comprising the steel thus has adequate weldability.

It is believed that the inclusion of higher carbon content in the steel composition provides a pathway for the formation of high strength grain structure in the steel. The steel prepared using the composition can form high strength grain regions earlier in the process of the final thermal treatment of the steel composition, which results in the increased yield strength for the resulting steel.

Thus, in an embodiment, a steel suitable for use in a flange for a wind tower, has a ladle composition comprising, in addition to iron: carbon at greater than 0.18 wt %, specifically greater than or equal to 0.185 wt %, more specifically greater than or equal to about 0.19 wt %, and still more specifically greater than or equal to 0.195 wt %. The steel also has a ladle composition comprising carbon in an amount of less than or equal to 0.23 wt %, specifically less than or equal to 0.22 wt %, more specifically less than or equal to 0.215 wt %, and still more specifically less than or equal to 0.21 wt %.

In an embodiment, a steel suitable for use in a flange for a wind tower, has a product composition comprising, in addition to iron: carbon at greater than 0.20 wt %, specifically greater than or equal to 0.205 wt %, more specifically greater than or equal to about 0.21 wt %, and still more specifically greater than or equal to 0.215 wt %. The steel also has a product composition comprising carbon in an amount of less than or equal to 0.25 wt %, specifically less than or equal to 0.24 wt %, more specifically less than or equal to 0.235 wt %, and still more specifically less than or equal to 0.23 wt %.

In a further embodiment, apart from carbon, the steel composition may comprise additional elements including manganese at 0.9 to 1.65 wt %; silicon at less than or equal to 0.5 wt %; phosphorous at less than or equal to 0.03 wt %; sulfur at less than or equal to 0.025 wt %; niobium at less than or equal to 0.05 wt %; vanadium at less than or equal to 0.12 wt %; titanium at less than or equal to 0.03 wt %; aluminum at greater than or equal to 0.02 wt %; chromium at less than or equal to 0.30 wt %; nickel at less than or equal to 0.5 wt %; molybdenum at less than or equal to 0.1 wt %; copper at less than or equal to 0.35 wt %; and nitrogen at less than or equal to 0.015 wt %. With the exception of carbon as described above, the amounts of the additional elements, meet the compositional specifications for S355NL steel according to EN 10 113-2:1993 specifications.

In an embodiment, the steel meets the performance requirements for S355NL steel according to EN 10 113-2: 1993. In another embodiment, the yield strength of an article consisting of the steel composition is greater than or equal to 295 Mega-Pascals as determined according to ASTM A961-02. In another embodiment, the Charpy V-notch toughness as determined at −40° C. is greater than or equal to 54 Joules (J), specifically greater than or equal to 60 J, and more specifically greater than or equal to 65 J, according to ASTM E23-01. In another embodiment, the steel composition has a carbon equivalence ($C_{eq}$) of less than or equal to 0.43 for an article having a thickness of less than or equal to 63 millimeters. In another embodiment, the steel composition has a carbon equivalence ($C_{eq}$) of less than or equal to 0.45 for an article having a thickness of greater than 63 millimeters. It will be understood by one skilled in the art that the amounts and type of additional elements included in the steel composition are selected such that the steel composition prepared therewith meets or exceeds the above desired mechanical properties.

In addition to improved yield strength, low temperature toughness, and weldability, the steel composition may further have improved tensile strength, good resistance to brittle fracture in both longitudinal and transverse directions, unchanged properties after stress-relieving and flame-straightening, resistance to lamellar tearing, and good internal soundness.

In an embodiment, a flange as disclosed herein is a ring shaped circular unit, fabricated from a steel having the composition disclosed herein. A flange is typically fabricated by slicing a section from a steel billet comprising the steel composition, heat treating and forging the section to provide the basic shape of the flange, and machining the rough-shaped flange to provide the finished flange. In this way, a billet may provide sufficient steel stock for about 10 flanges. In another embodiment, the flange may be fabricated by cold rolling a slab of the steel to form a thick plate of the desired thickness, and cutting the flange out of the plate in 4 to 6 sections, which are then welded end-to-end to form the flange shape. In another embodiment, plate steel may be cut into sections (typically by the steel manufacturer) to form bar stock, which is then shaped by bending the bar stock around a template having the inside diameter of the flange, and secured by welding the ends together to form the rough flange shape. The rough flange is then machined according to the above method, to provide a final finished flange with the desired dimensions, features, and finished properties. Heat treating may also be performed. The finished flange is subsequently incorporated onto the ends of modular sections of the wind tower. The modular sections are selected and affixed to each other during assembly at the site of construction and use to provide a wind tower having the desired overall height.

The flanges disclosed herein may be of different diameters depending upon the size of the tower segment it will be incorporated into. The flange has approximately the same outside diameter as the end of the wind tower segment to which it is welded. Where the flange is ring-shaped, the ring has a width as measured by the difference in measurement between the radius of the inside diameter and the radius of the outside diameter, and in the plane of the diameter of the flange, of about 150 to about 300 millimeters. Similarly, the flange has a thickness orthogonal to the plane of the diameter of the flange of about 100 millimeters to about 200 millimeters.

In an exemplary embodiment, a flange 100 is shown in FIG. 1. The flange has an outer diameter 101, and inner diameter 102, and a width 103 corresponding to the difference between the outside diameter 101 and the inside diameter 102, divided by two, and expressed in millimeters. The width of the flange may also be determined by the difference (in mm) between the outside radius and the inside radius. The flange is machined to have a plurality of holes there through, wherein the holes are oriented normal to the thickness of the flange. The through holes are arrayed along a circumferential pattern on the flange, and are of a suitable size to accommodate a bolt for affixing the matching flanges (and hence the tower segments) together. Flanges, which are used to join adjacent wind tower sections, and which are matched to each other, are typically affixed to each other by inserting a threaded bolt through each of the aligned holes in the matched flanges, and threading a nut onto each bolt.

Figure 2:
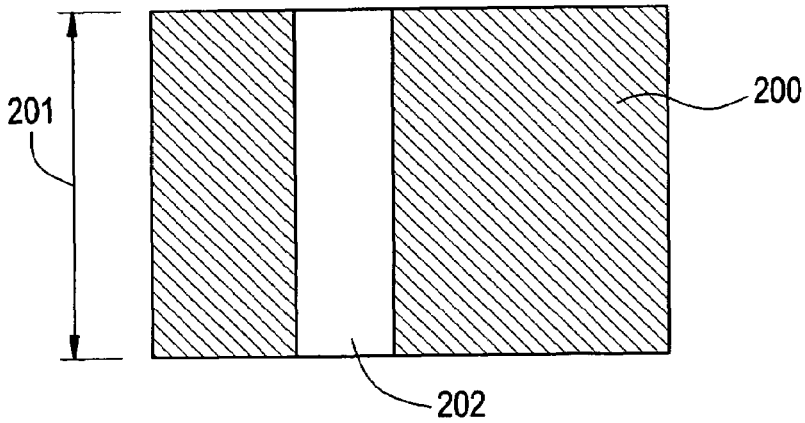
FIG. 2 shows a cross-sectional view of a flange.
Figure 3:
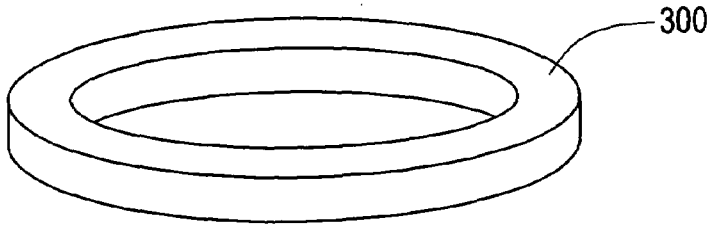
FIG. 3 shows a side view of a flange.
Figure 4:
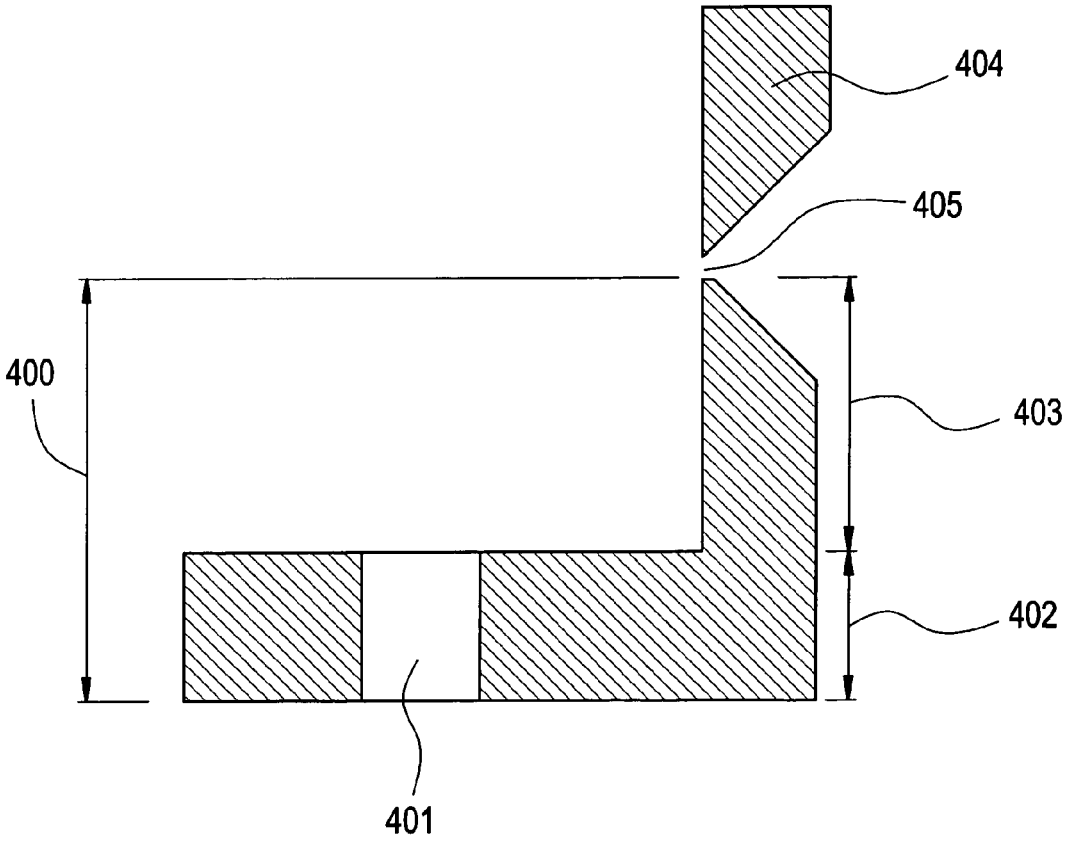
FIG. 4 shows a cross-sectional view of a base flange.
Figure 5A:
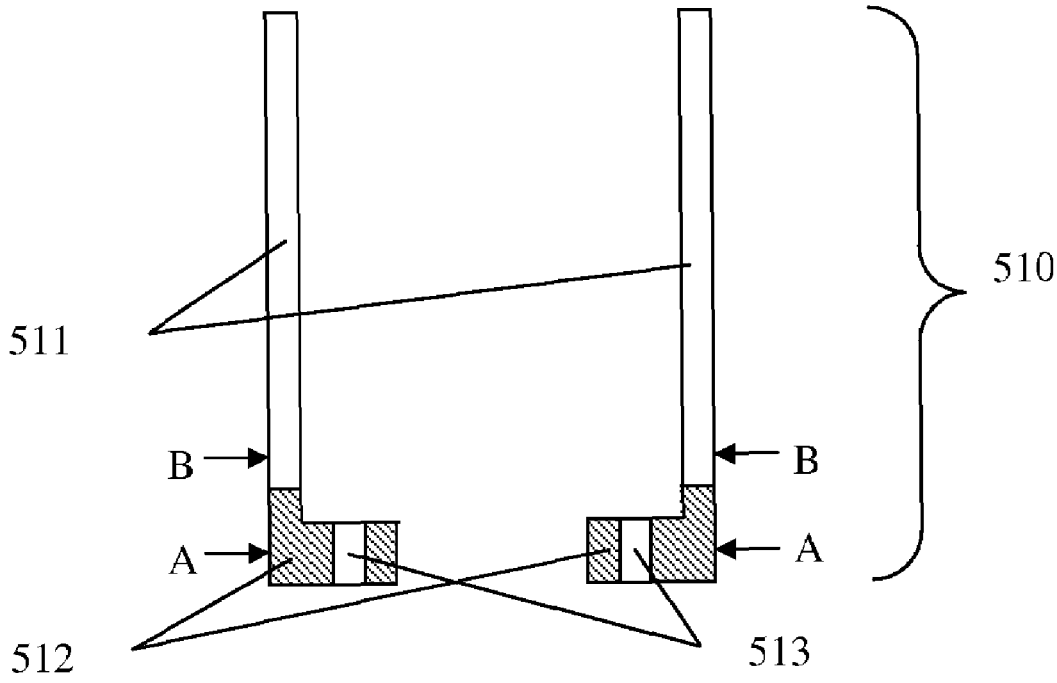
FIGS. 5A and 5B show a cross-sectional view of an end of a wind tower with a flange affixed (FIG. 5A), and ends of two different wind tower sections with matching flanges affixed to each section (FIG. 5B).
Figure 5B:
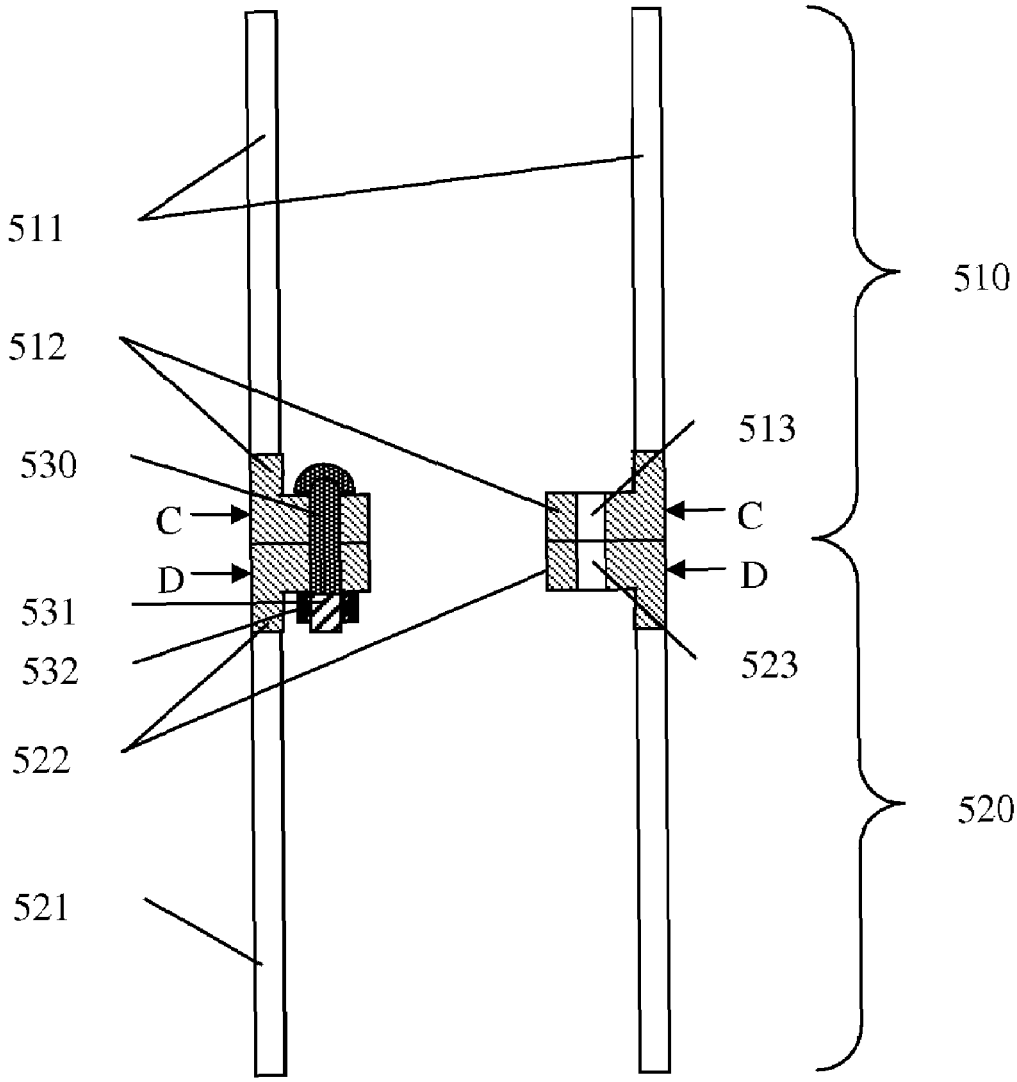

FIG. 2 shows a cross-sectional, radial view of a flange, wherein a tower section can be welded directly to the flange. The cross section of flange 200 has a thickness 201, expressed in millimeters. A plurality of holes may be drilled through the flange, where a representative hole 202 is shown in cross section. FIG. 3 shows a perspective view of a flange 300. The holes are not shown in either of FIGS. 1 or 3. In addition, FIG. 4 shows a cross-sectional view of a base flange 400, used to anchor the tower section to the tower support base. In this view, the base flange 400 having through holes 401, comprises the flange 402 having a weld neck 403, which is welded to can 404 at weld joint 405, to affix the flange to the tower section. The base flange may have weld neck 403 machined from a thick flange stock, or alternatively or may have the weld neck 403 itself welded to the flange 402. FIG. 5A shows a cross-sectional view of an end of a wind tower segment 510, having a flange 512 having an outside diameter measured at the outside edge of the flange (between arrows A) that is coincident with the outside diameter of an open end of a section of a wind tower 511 (measured between arrows B), and wherein the flange 512 is affixed to an open end of the wind tower section 511, such that the circumference B of the wind tower section 511 and circumference A of the flange 512 are coincident. The flange 511 has a plurality of through holes 513 oriented normal to the thickness of the flange, wherein the through holes 513 are affixed along a circumferential pattern on the flange 512. FIG. 5B shows a cross-sectional view of the ends of two wind tower segments 510, 520, in which two flanges (512, 522) of the same circumference (C and D) and affixed to two different wind tower sections (511, 521) are affixed to one another. The two flanges 512, 522 are affixed to one another by aligning the flanges 512, 522 such that the plurality of holes 513, 523 of each flange (512 and 522, respectively) are aligned, inserting a bolt 530 with a threaded end 531 through each of the plurality of holes 513, 523 in the flanges 512, 522, and securing the bolts 530 by screwing a nut 532 onto the threaded end 531 of the bolt 530.

Flanges are typically manufactured by cutting a slice from a steel billet comprising steel of the desired steel composition, as received from the foundry. The slice, also referred to as a slug, is of an appropriate size and thickness to allow rough forming of the shape of the flange by forging. The flange may be roughly shaped from the plate by using a metal forging process. Typically, the rough shape is forged from a section sliced from a steel billet comprising the above steel composition. The roughly shaped flange is further shaped by turning on a lathe, grinding, shaving, cutting, or a combination comprising at least one of the foregoing processes, to achieve the desired inner diameter, outer diameter, thickness, and overall shape including any lip, groove, hole, notch or other feature desired. Holes for accommodating the bolts are drilled into the flange after shaping the roughly shaped flange. The flange may be subject to final polishing or machining to remove aberrations prior to affixing to the can or tower segment. In other manufacturing methods, the flange may be fabricated from cold rolled steel slabs. In this method, the slab steel is cold rolled to form a thick plate, from which 4 to 6 segments may be cut to form the circumference of the flange. The sections are welded end to end to form the flange shape, which is then machined and finished as desired. In another method, bar stock may be obtained from the steel manufacturer, as cut using oxygen cutting from sections of thick plate. The bar stock is then heated and shaped into a ring shape by bending around a form, and is then end welded using suitable welding methods to form the basic shape of the flange. The rough flange shape is then rolled, pressed, and machined as described above to form a flange having the desired dimensions and uniformity, and having the desired features.

Wind towers may be constructed of relatively short cylindrical steel substructures, also referred to herein as "cans", wherein two or more cans are welded together end to end. A can is formed by shaping a long rectangular or approximately trapezoidal plate of a suitable steel, by rolling it orthogonal to the width. Rolling the plate provides a curve to the rolled steel, and form the plate into a cylinder, with the length forming the circumference of the cylinder, and the width forming the height of the resulting can. After forming the can shape, the ends of the long dimension of the rectangle which are normal to the height of the can (i.e., are longitudinal) are welded to each other to complete the formation of the cylindrical substructure. A series of cans having matching end circumferences are then welded together at the matching ends using girth welds to form a tapering cylinder with a net length corresponding to the additive lengths of the cans so welded together. In an embodiment, each individual can has a tapered shape with a larger diameter opening at one end, and a smaller diameter opening at the other end, wherein the smaller opening is matched in circumference to the larger opening of the next can to be welded to it. Typically, about 6 to about 14 cans are welded together using girth welds. The overall length of the girth-welded series of cans may be about 20 to about 30 meters.

A flange is affixed to each end of the tower segment formed from the assembled and welded cans. The flange may be affixed to the end of the tower segment (i.e., to the can used as an end of the segment) before the cans are assembled; when a portion of the tower segment having the end can is partially complete; or upon completion of the girth welding of all of the cans in the tower section. In an embodiment, a flange is affixed to each end can prior to girth welding the cans together to form the tower segment. Other fixtures including wiring harnesses, platforms, ladders, holds, brackets, and the like, may also be included in the tower segment.

Wind towers are typically assembled from smaller subunits at the site of operation of the tower. Erecting the wind tower typically involves pouring a concrete base with bolts matching the flange on the lowest section of the tower (the door section); erecting the tower itself by raising a first (lowest) section and affixing it to the base, then adding a second section to the first, and bolting the sections together via the flanges as described above; followed by addition of an optional third or fourth tower segment, bolted to the second tower segment through the matching flanges. A nacelle is affixed to the top of the tower, the turbine is attached to the drive shaft connecting to the generator in the nacelle, and the wiring connections are made. The tower height may also be determined by the size of the generating units (i.e., according to generating capacity) from standard sized units of, for example 1.5 megawatts to larger units of, for example, 3 megawatts or larger. The larger units may require longer turbine blades, and the overall height of the supporting tower may therefore also be increased commensurately. The advantage to constructing the tower in this way is that the components are thus modular and hence more easily transported to the construction site. Modular assembly can make the final assembly of a wind tower at the site of operation a more rapid, economical process.

As disclosed herein, yield strength is determined using a test article having dimension of 450 mm in length, 50 mm wide, and 13 mm thickness according to the method of ASTM A961-01. Charpy V-notch testing is determined according to ASTM E23-01, using a test article with a dimension of 50 mm in length, 10 mm height, and 10 mm thickness, with a v-shaped notch of 2 mm depth scribed longitudinally along the sample. Other tests that may be used to characterize the steel disclosed herein are found in ASTM A370-05.

The singular forms "a," "an," and "the" include plural referents unless the context clearly dictates otherwise. The endpoints of all ranges reciting the same characteristic are combinable and inclusive of the recited endpoint. All references are incorporated herein by reference.

While typical embodiments have been set forth for the purpose of illustration, the foregoing descriptions should not be deemed to be a limitation on the scope herein. Accordingly, various modifications, adaptations, and alternatives may occur to one skilled in the art without departing from the spirit and scope herein.

We claim:

1. An article comprising a steel consisting essentially of iron, carbon in an amount greater than 0.18 weight percent and less than or equal to 0.23 weight percent by ladle analysis, and further meets the compositional requirements for S355NL steel for elements other than carbon, according to European Norm EN 10 113-2:1993, wherein the steel has a carbon equivalent $C_{eq}$ of less than 0.45, wherein the steel of the article has a low temperature Charpy V-notch toughness of greater than or equal to 54 Joules when measured at −40° C. according to ASTM E23-01, and wherein the steel of the article further meets the other test requirements for S355NL steel according to European Norm EN 10 113-2:1993.

2. The article of claim 1 wherein the steel comprises greater than or equal to 0.20 to less than or equal to 0.25 percent by weight of carbon by product analysis.

3. The article of claim 1, wherein the article has a thickness of greater than 63 millimeters.

4. The article of claim 1, wherein the article has a thickness of less than or equal to 63 millimeters, and wherein the steel has a carbon equivalent $C_{eq}$ of less than 0.43.

5. The article of claim 1 having a thickness of less than or equal to 150 millimeters.

6. The article of claim 5, having a thickness of greater than 100 millimeters.

7. The article of claim 1 having a thickness of greater than 150 millimeters.

8. The article of claim 1 wherein the steel is normalized steel.

9. The article of claim 1 wherein the article is a flange for use in a wind tower.

10. A flange comprising a steel, wherein the steel consists essentially of:

iron, carbon in an amount greater than 0.18 weight percent and less than or equal to 0.23 weight percent by ladle analysis, and greater than 0.20 weight percent to less than or equal to 0.25 weight percent by product analysis, and wherein the steel further meets compositional requirements for S355NL steel for elements other than carbon, according to European Norm EN 10 113-2:1993, wherein the steel is weldable, wherein the steel has a low temperature Charpy V-notch toughness of greater than or equal to 54 Joules when measured at −40° C. according to ASTM E23-01, and wherein the steel further meets the other test requirements for S355NL steel according to European Norm EN 10 113-2:1993.

11. The flange of claim 10 having an outside diameter measured at the outside edge of the flange that is coincident with the outside diameter of an open end of a section of a wind tower, and wherein the flange is affixed to an open end of the wind tower section, such that the circumferences of the wind tower section and flange are coincident.

12. The flange of claim 11 having a plurality of through holes oriented normal to the thickness, wherein the through holes are affayed along a circumferential pattern on the flange.

13. The flange of claim 12, wherein two flanges of the same circumference and affixed to two different wind tower sections are affixed to one another.

14. The flange of claim 13, wherein the two flanges are affixed to one another by aligning the flanges such that the plurality of holes of each flange are aligned, inserting a bolt with a threaded end through each of the plurality of holes in the flanges, and securing the bolts by screwing a nut onto the threaded end of the bolt.

15. The flange of claim 10, wherein the flange is used in a wind tower operating at a temperature of greater than or equal to −30° C., and wherein the flange remains substantially free of stress induced damage for a period of less than or equal to 20 years.

16. A wind tower comprising the flange of claim 10.

17. A method of making a flange for use in a wind tower, comprising shaping a section of steel comprising:

a steel composition comprising:

iron, greater than 0.18 weight percent to less than or equal to 0.23 weight percent carbon by ladle analysis, and additional elements, wherein the steel composition meets compositional requirements for S355NL steel for the additional elements according to European Norm EN 10 113-2:1993;

wherein the steel has a low temperature Charpy V-notch toughness of greater than or equal to 54 Joules when measured at −40° C. according to ASTM E23-01, and wherein the steel further meets the other test requirements for S355NL steel according to European Norm EN 10 113-2:1993.

18. The method of claim 17, wherein shaping comprises forging; cold rolling and welding; or bending and welding.

19. A flange prepared by the method of claim 17.

20. The steel of claim 1, consisting of iron, carbon in an amount greater than 0.18 weight percent and less than or equal to 0.23 weight percent by ladle analysis, and further meeting the compositional requirements for S355NL steel for elements other than carbon, according to European Norm EN 10 113-2:1993.

* * * * *